United States Patent [19]

Nakajima et al.

[11] Patent Number: 4,704,072

[45] Date of Patent: Nov. 3, 1987

[54] COMPRESSOR WITH ROTATION SENSOR

[75] Inventors: Nobuyuki Nakajima; Tadahiro Takahashi, both of Konan, Japan

[73] Assignee: Diesel Kiki Co., Ltd., Tokyo, Japan

[21] Appl. No.: 4,134

[22] Filed: Jan. 16, 1987

[30] Foreign Application Priority Data

Jan. 20, 1986 [JP] Japan ..... 61-6168[U]

[51] Int. Cl.[4] ..... F04B 49/00; F16D 19/00

[52] U.S. Cl. ..... 417/223; 418/69; 192/84 A

[58] Field of Search ..... 417/223, 319; 418/69; 192/84 A, 84 B

[56] References Cited

U.S. PATENT DOCUMENTS 4,393,966 7/1983 Kono et al. ..... 417/223

4,487,029 12/1984 Hidaka et al. ..... 417/319

FOREIGN PATENT DOCUMENTS 3506063 8/1985 Fed. Rep. of Germany ..... 418/69

*Primary Examiner*—W. L. Freeh

*Attorney, Agent, or Firm*—Wenderoth, Lind & Ponack

[57] ABSTRACT

A compressor having a rotation sensor disposed in a portion provided for mounting a magnetic clutch. The rotation sensor is compressed of a detectable portion co-rotatable with a drive shaft of the compressor, and a detecting portion disposed on a cylindrical head in confronting relation to the detectable portion. The rotation sensor is disposed outside of a seal means disposed between the drive shaft and the cylinder head for providing a hermetic seal therebetween. With this construction, no separate seal means is necessary for the rotation sensor.

9 Claims, 6 Drawing Figures

COMPRESSOR WITH ROTATION SENSOR

FIELD OF THE INVENTION

The present invention relates generally to compressors, and more particularly to a compressor having a rotation sensor for use with an automobile air conditioner et. al.

PRIOR ART

When slidingly moving components of a compressor are seized or sticked together, a drive system of the compressor is subjected to a sudden increase of load which would cause an accident to the drive system, such as breakage of a V-belt. With the foregoing problem in view, various attempts have been proposed to detect a slip of the V-belt through the comparison of the r.p.m. (revolutions per minute) of the compressor with the engine r.p.m. so that upon detection of such belt slip, a magnetic clutch is disengaged to strop the compressor for thereby insuring a safe operation of the engine. Several improvements in and relating to rotation sensors for the compressors have been proposed. One such improved rotation sensor is disclosed in Japanese Utility Model Laid-open Publication No. 58-187769, wherein a detecting portion is disposed in confronting relation to the retainer of a mechanical seal. Japanese Utility Model Laid-open Publication No. 60-90675 shows another rotation sensor which includes a detecting portion disposed in confronting relation to rivets securing a clutch plate of a magnetic clutch.

With the detecting portion disposed opposite to the retainer of the mechanical seal, the first-mentioned rotation sensor requirs only a small space for its installation. However, a problem is that since the detecting portion is mounted in a hole in a cylinder head, a separate seal must be provided between the cylinder head and the detecting portion. This construction would result in an increased production cost. On the other hand, the last-mentioned rotation sensor requrirs no seal means as its deteting portion is disposed opposite to the rivets of the magnetic clutch. However a relatively large space is necessary to provide a support member for retaining the detecting portion and the clutch in confronting disposition.

SUMMARY OF THE INVENTION

It is accordingly an object of the present invention to provide a compressor having a rotation sensor, which can overcome or substantially eliminate the foregoing drawbacks of the prior art devices, and which requires no separate seal means for the rotation sensor and is compact in construction.

Another object of the present invention is to provide a compressor with a rotation sensor, which is simple in construction and hence can be manufactured at a low cost.

A further object of the present invention is to provide a compressor having a rotation sensor which functions as a temperature sensor for detecting the temperature of the compressor simultaneously with detection of the number of rotation of the compressor.

According to the present invention, the foregoing and other objects are attained by a compressor comprising: a cylinder head; a drive shaft rotatably received in the cylinder head; seal means desposed between the cylinder head and the drive shaft for providing a hermetic seal therebetween, the cylinder head including a tubular clutch mounting portion disposed outside of the seal means; a magnetic clutch mounted on the clutch mounting portion for being operatively connected with the drive shaft; and a rotation sensor disposed in the clutch mounting portion and including a detectable portion connected with the drive shaft for co-rotation therewith and a detecting portion secured to the cylinder head in confronting relation with the detectable portion.

With this construction, when the detectable portion is co-rotating with the drive shaft, the rotation of the drive shaft is detected by the detecting portion which is disposed in confronting relation to the detectable portion. Since both the detecting and detectable portions are disposed outside of the seal means, they require no separate seal. A further advantage is in that the detecting and detectable portions are disposed inside of the clutch mounting portion of the cylinder head with the result that only a relatively small space is necessary for their installation.

Many other advantages, features and other objects of the present invention will become manifest to those versed in the art upon making reference to the detailed description and the accompanying sheet of drawing in which preferred structural embodiments incorporating the principles of the present invention are shown by way of illustrative example.

DETAILED DESCRIPTION

Figure 1:
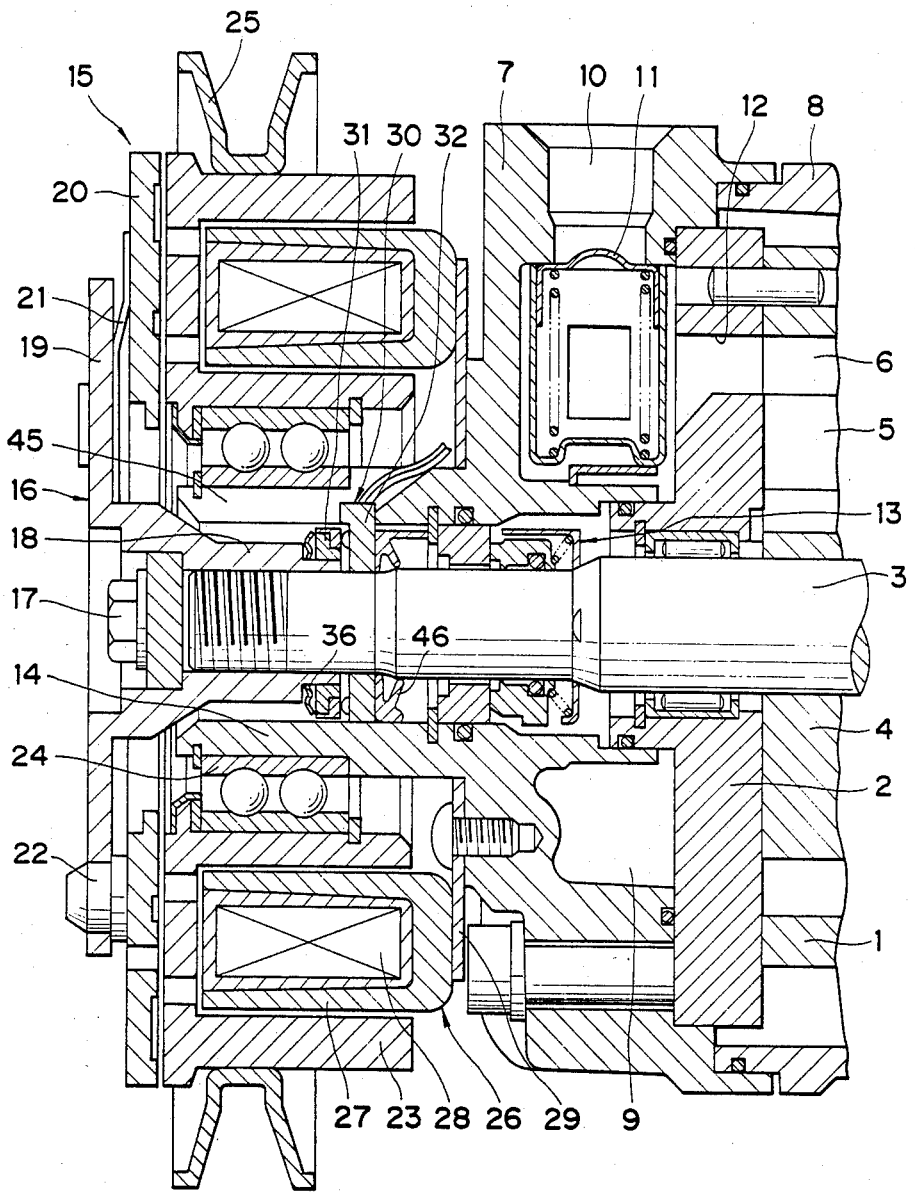
FIG. 1 is a fragmentary cross-sectional view of a compressor according to a first embodiment of the present invention.

Like or corresponding parts are denoted by like or identical reference characters throughout several views of the accompanying drawings.

Figure 2:
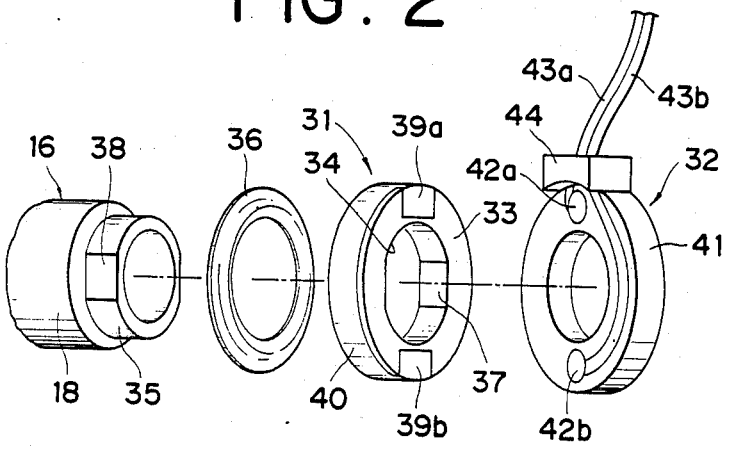
FIG. 2 is an exploded perspective view of a rotation sensor and parts related thereto of the compressor shown in FIG. 1.

FIGS. 1 and 2 show a compressor according to a first embodiment of the present invention. The compressor is of the rotary vane type as known per se and includes a cylinder 1 having an elliptical inner peripheral wall, a pair of side blocks 2 (only one shown) disposed on opposite sides of the cylinder 1, and a rotor 4 rotatably disposed in a chamber defined between the cylinder 1 and the side blocks 2, the rotor 4 being fixedly connected to a drive shaft 3. The rotor 4 has a plurality of vanes 5 slidably mounted thereon at circumferentially spaced intervals so that a plurality of working chambers 6 are defined jointly by and between the cylinder 1, the side blocks 2, the rotor 4 and the individual vanes 5. The cylinder 1 and the side blocks 2 are surrouded by a cylinder head 7 and a shell 8 secured to the cylinder head 7. The cylinder head 7 includes a low pressure chamber defined therein The low pressure chamber 9 communicates with an inlet port 10 through a check valve 11 and is communicatable with the respective working chambers 6 through an inlet opening 12 defined in one of the side block 2.

With this construction, when the drive shaft 3 is rotated to turn the rotor 4, the vanes 5 slide along the inner peripheral wall of the cylinder 1 whereupon the volume of each working chamber 6 varies gradually so that a gas or a liquid is sucked from the intake opening 12 successively into the working chambers 6, then is progressively compressed in the working chambers 6 and finally is discharged therefrom through an outlet (not shown) defined in the cylinder 1.

The compressor further includes a seal means 13 composed of a known mechanical seal and disposed between the drive shaft 3 and the cylinder head 7 to provide a hermetic seal therebetween. The cylinder head 7 includes a tubular mounting portion 14 extending axially outwardly of the seal means 13 for mounting thereon a magnetic clutch 15.

The magnetic clutch 15 includes a hub 16 secured by a screw 17 to an end of the drive shaft 3. The hub 15 is composed of a tubular portion 18 and an annular flange portion 19 extending radially outwardly from one end of the tubular portion 18. The tubular portion 18 is received in the tubular mounting portion 14 and is fitted over an end portion of the drive shaft 3. The flange portion 19 resiliently supports thereon an annular disc-like clutch plate 20 of magnetic material with the agency of a leaf spring 21. A stopper 22 of rubber or the other elastic material is mounted on the flange portion 19 and is held in abutment with the clutch plate 20 to restrain the movement of the latter.

The clutch plate 20 faces toward one end face of an annular disc-like magnetic pole plate 23 with a predetermined clutch gap left therebetween. The magnetic pole plate 23 is rotatably supported on the tubular clutch mounting portion 14 of the cylinder head 7 via a ball bearing 24. Secured to the outer periphery of the magnetic pole plate 23 is a pulley 25 having a V-shaped circumferential groove in which a V-belt (not shown) is retained so that the driving power is transmitted from an engine through the V-belt to the pulley 25. The magnetic pole plate 23 includes an intermediate annular hollow portion in which a magnetic-force generating portion 26 is received. This portion 26 includes an annular yoke 26 having a concentric groove in which an annular exciting coil 28 is mounted, the yoke 27 being connected by an attachment plate 29 to an end face of the cylinder head 7.

The compressor also includes a rotation sensor 30 composed of a detectable portion 31 co-rotatable with the drive shaft 3, and a detecting portion 32 confronting the detectable portion 31, both portions 31, 32 being disposed radially inwardly of the tubular clutch mounting portion 14.

As shown in FIG. 2, the detectable portion 31 includes an annular disc-like body 33 of an insulative material, such as plastics. The body 33 has a central hole 34 in which a stepped end portion 35 of the hub's tubular portion 18 is inserted with a corrugated spring retainer ring 36 disposed therebetween. The central hole 34 in the body 33 includes a pair of diametrically opposite flat engagement surfaces 37 fitted over mating flat engagement surfaces 38 on the stepped section 35 of the hub 16 so as to prevent the detectable portion 31 from rotating with respect to the hub 16. The detectable portion 31 has a pair of detectable contacts **39*a*, 39*b* disposed on one end face thereof in diametrically opposite relation to one another. The contacts 39*a*, 39*b* are electrically connected together by a conducting portion 40 extending along the outer periphery of the body 33 of the detectable portion 31**.

The detecting portion 32 also includes an annular disc-like body 41 of an insulative material such as plastics. The body 41 has a pair of diametrically opposite detecting contacts **42*a*, 42*b* disposed on one end face thereof facing toward said one end face of the detectable portion 31. The detecting contacts 42*a*, 42*b* are engageble with the detectable contacts 39*a*, 39*b*, respectively, in a direction parallel to the axis of the drive shaft 3. The detecting contacts 42*a*, 42*b* are connected with a pair of lead wires 43*a*, 43*b*, respectively, through which output detecting signals are delivered from the contacts 42*a*, 42*b* to a non-illustrated control unit. The body 41 includes a generally rectangular locking projection 44 disposed on the outer periphery thereof. The locking projection 44 is fitted in an axial slot 45 defined in the tubular clutch mounting portion 14, as shown in FIG. 1, for preventing rotation of the detecting portion 32 with respect to the cylinder head 7**.

The detectable portion 31 and the detecting portion 32 are forced by the spring retainer ring 36 and a resilient pressure ring 46 in facewise contact with each other between the hub 16 and the seal means 13.

The compressor of the foregoing construction operates as follows: The driving force is transmitted from the engine through the V-belt to the pulley 25 to cause the magnetic pole plate 23 to co-rotate with the pulley 25. When the exciting coil 28 is energized to complete a magnetic circuit extending through the clutch plate 20, the magnetic pole plate 23 and the yoke 27 with the result that the clutch plate 20 is attracted by the magnetic pole plate 23 and brought into frictional engagement with the magnetic pole plate 23 against the force of the leaf spring 21. Accordingly, the rotational motion of the pulley 25 is transmitted to the drive shaft 3 successively through the magnetic pole plate 23, the clutch plate 20, the leaf spring 21 and the hub 19, to the drive shaft 3, thereby rotating thedrive shaft 3, whereupon the rotor 4 is rotated to compress the gas in the cylinder 1.

Rotation of the drive shaft 3 also causes the detectable portion 31 to co-rotate with the drive shaft 3 since the detectable portion 31 is non-rotatably connected with the hub 16. As described above, the detecting contacts **42*a*, 42*b* on the detecting portion 32 are disposed in confronting relation to the detectable contacts 39*a*, 39*b* on the detectable portion 31. With this construction, when the detectable contacts 39*a*, 39*b* engage the detecting contacts 42*a*, 42*b* while a potential or voltage is being applied across the detecting contacts 42*a*, 42*b*, an electric current flows between these contacts 42*a*, 42*b* through the detecting contacts 39*a*, 39*b* and the conducting portion 40. Such electric current disappears upon disengagement of the detectable contacts 39*a*, 39*b* from the detecting contacts 42*a*, 42*b*. Consequently, ON-Off output signal pulses are delivered through the lead wires 43*a*, 43*b* to the non-illustrated control unit, the number of signal pulses corresponding to the number of revolutions of the drive shaft 3 (two successive sets of ON-OFF signal pulses are delivered per a single revolution of the drive shaft 3** in the illustrated embodiment).

Figure 3:
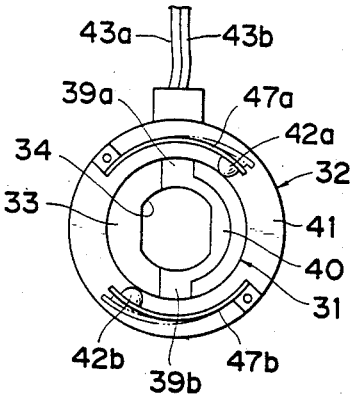
FIG. 3 is is a side elevational view of a cooperative pair of detecting and detectable portions of a rotation sensor according to a second embodiment.
Figure 4:
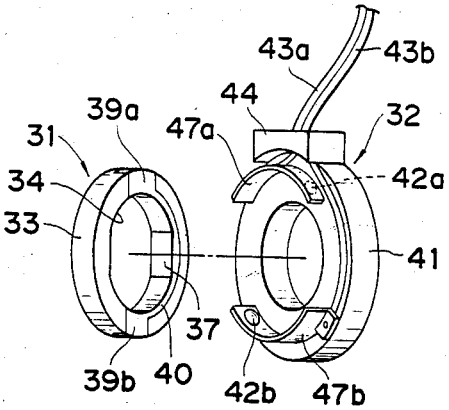
FIG. 4 is an exploded perspective view of the rotation sensor shown in FIG. 3.

FIGS. 3 and 4 show a second embodiment of the present invention. Contrary to the just-described first embodiment in which the detecting and detectable contacts engage together in a direction parallel to the axis of the drive shaft 3, these contacts of the second embodiment are engageable with each other in a radial direction perpendicular to the axis of the drive shaft 3.

Stated more specifically, the detectable contacts 39*a*, 39*b* are disposed on the outer periphery of the body 31 of the detectable portion 31 in diametrically opposite relation to one another. The detecting contacts 42*a*, 42*b* are disposed respectively on one end of a pair of resilient arcuate contact plates 47*a*, 47*b* disposed on one end face of the body 31 of the detecting portion 31 in diametrically opposite relation to one another, the other ends of the contact plates 47*a*, 47*b* being secured to the body 41. The detectable portion 31 is disposed in a space defined between the arcuate contact plates 47*a*, 47*b* which are urged against the outer periphery of the detectable portion by the resiliency of the respective contact plates 47*a*, 47*b* so that the detecting contacts 42*a*, 42*b* are frictionally engageable with the detectable contacts 39*a*, 39*b* upon rotation of the drive shaft 3.

The contact plates 47*a*, 47*b* are made of a thermally deflectable material such as shape-memory alloy, a thermometal or a bimetal so that when the ambient temperature exceeds a predetermined value, the plates 47*a*, 47*b* expand radially outwardly away from each other to thereby hold the detecting contacts 42*a*, 42*b* out of engagement with the detectable contacts 39*a*, 39*b*. A further increase in ambient temperature can be detected by the rotation sensor as the latter continuously outputs an OFF signal under such high temperature condition. The rotation sensor thus constructed also serves as a temperature sensor.

Apart from the foregoing construction, only the detecting contacts 42*a*, 42*b* may be formed of a thermally deflectable material. Alternatively, such thermally deflectable material may be used to construct the detectable contacts 39*a*, 39*b*.

Figure 5:
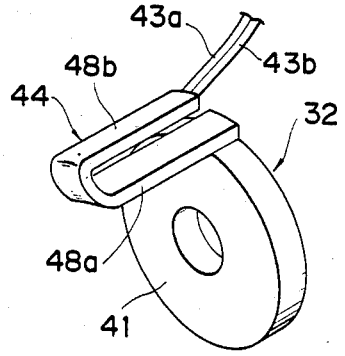
FIG. 5 is a perspective view of a detecting portion according to a third embodiment.
Figure 6:
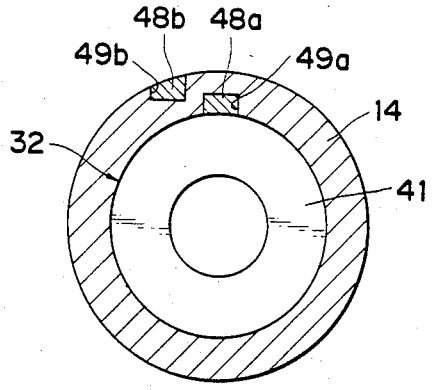
FIG. 6 is a cross-sectional view illustrative of the manner in which the detecting portion of FIG. 5 is mounted.

A third embodiment shown in FIGS. 5 and 6 differs from the foregoing two embodiments in the manner in which a detecting portion 32 is secured to the cylinder head.

The detecting portion 32 includes an annular body 41 and a locking projection 44 folded in a twisted or distorted U-shape. The U-shaped locking projection 44 has at its opposite ends a pair of engagement portions 48*a*, 48*b* fittedly received in a pair of slots 49*a*, 49*b*, respectively, defined in the inner and outer peripheral surfaces of a tubular clutch mounting portion 14 of the cylinder head.

The rotation sensors of the present invention have various advantages. Since the rotation sensors are of the contact type, they can be manufactured at less cost and are operative reliably without causing fluctuation of output signals on temperature change or pressure change. The sensors are highly resistant to or inert against noises so that they require neither selection of a desired trigger level nor provision of a corrective circuit.

It is possible to employ a rotation sensor of the non-contact type as known per se, such as a reed switch, a photoelectric pickup, an electromagnetic pickup or an electromagnetic switch employing a Hall element.

Throughout the foregoing embodiments, the detectable portion 31 is mounted on the hub 16 of the magnetic clutch 15, however, the present invention is not limited to such embodiments. Rather, it also covers such a modification wherein the detectable portion 31 is attached directly to the drive shaft 3. Furthermore, the detecting portion 32 may be secured to any other portion, such as an end of the seal means 13 so long as it is held immoval with respect to the cylinder head 7.

Obviously, many modifications and variations of the present invention are possible in the light of the above teachings. It is therefore to be understood that within the scope of the appended claims, the invention may be practiced otherwise than as specifically described.

What is claimed is:

1. A compressor comprising:

(a) a cylinder head;

(b) a drive shaft rotatably received in said cylinder head;

(c) seal means desposed between said cylinder head and said drive shaft for providing a hermetic seal therebetween, said cylinder head including a tubular clutch mounting portion disposed outside of said seal means;

(d) a magnetic clutch mounted on said clutch mounting portion for being operatively connected with said drive shaft; and (e) a rotation sensor disposed in said clutch mounting portion and including a detectable portion connected with said drive shaft for co-rotation therewith and a detecting portion secured to said cylinder head in confronting relation with said detectable portion.

2. A compressor according to claim 1, said tubular clutch mounting portion of the cylinder head having an axial slot extending parallel to said drive shaft, said detecting portion including a locking projection fittedly received in said slot.

3. A compressor according to claim 2, said slot being defined in each of an outer peripheral surface and an inner peripheral surface of said tubular clutch mounting portion of the cylinder head, said locking projecting of the detecting portion being folded into a twisted U-shape.

4. A compressor according to claim 1, said detectable portion including a first body of an insulative material and at least two electrically connected detectable contacts disposed on said first body at circumferentially spaced intervals, said detecting portion including a second body of an insulative material and detecting contacts equal in number to said detectable contacts and disposed on said second body at circumferentially spaced intervals, said detectable contacts being engageable with said detecting contacts upon rotation of said drive shaft to open and close the detecting contacts in an ON-OFF manner.

5. A compressor according to claim 4, said detectable contacts being formed of a thermally deflectable material capable of deflecting on temperature change.

6. A compressor according to claim 6, said detecting contacts being formed of a thermally deflectable material capable of deflecting on temperature change.

7. A compressor according to claim 4, said detectable and detecting contacts being engageable with each other in a direction parallel to the axis of said drive shaft.

8. A compressor according to claim 4, said detectable and detecting contacts being engageable with each other in a direction perpendicular to the axis of said drive shaft.

9. A compressor according to claim 8, said detecting portion including at least two contact plates resiliently urged against said detectable portion.

* * * * *